US007435520B2

(12) United States Patent
Bae

(10) Patent No.: US 7,435,520 B2
(45) Date of Patent: Oct. 14, 2008

(54) ELECTROPHOTOGRAPHIC DEVELOPING AGENT

(75) Inventor: Hyun-wook Bae, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 469 days.

(21) Appl. No.: 11/182,861

(22) Filed: Jul. 18, 2005

(65) Prior Publication Data

US 2006/0110673 A1 May 25, 2006

(30) Foreign Application Priority Data

Nov. 22, 2004 (KR) ..... 10-2004-0095906

(51) Int. Cl.
*G03G 9/08* (2006.01)

(52) U.S. Cl. ..... 430/108.6; 430/108.7; 399/252

(58) Field of Classification Search ..... 430/108.6, 430/108.7; 399/252
See application file for complete search history.

(56) References Cited

U.S. PATENT DOCUMENTS

| | | | | |
|---|---|---|---|---|
| 2002/0142242 | A1* | 10/2002 | Inoue et al. | 430/110.3 |
| 2005/0026089 | A1* | 2/2005 | Ogawa et al. | 430/405 |

FOREIGN PATENT DOCUMENTS

| | | |
|---|---|---|
| JP | 8-101533 | 4/1996 |
| JP | 10-10770 | 1/1998 |
| JP | 11-212293 | 8/1999 |
| JP | 2000-206730 | 7/2000 |
| JP | 2003-277054 | 10/2003 |

* cited by examiner

*Primary Examiner*—Mark A Chapman
(74) *Attorney, Agent, or Firm*—Roylance, Abrams, Berdo & Goodman, L.L.P.

(57) ABSTRACT

Provided is an electrophotographic developing agent including: toner particles including a binder resin, a colorant, and a charge control agent; and an external additive added to the surface of the toner particles, wherein the external additive includes at least one inorganic particulate component and at least two types of strontium titanate particulate component having different mean primary particle diameters. Typically, the inorganic particulate component is not strontium titanate. Also, an electrophotographic image forming apparatus using the electrophotographic developing agent is provided. The strontium titanate particulate component having different mean primary particle diameters are used as an external additive to maintain uniform charging characteristics and to prevent fog in a non-image area, thereby obtaining good image quality. In addition, the external additives prevent deposition of the developing agent on a developing agent regulating blade due to stress when the developing agent is used for a long time.

13 Claims, 1 Drawing Sheet

ELECTROPHOTOGRAPHIC DEVELOPING AGENT

BACKGROUND OF THE INVENTION

This application claims the priority of Korean Patent Application No. 10-2004-0095906, filed on Nov. 22, 2004, in the Korean Intellectual Property Office, the disclosure of which is incorporated herein by reference in its entirety.

1. Field of the Invention

The present invention relates to an electrophotographic developing agent. More particularly, the invention relates to an electrophotographic developing agent including at least two types of strontium titanate particulate components having different average primary particle diameters, for use in a developing apparatus of an electrophotographic image processing device.

2. Description of the Related Art

Electrophotographic image processing devices such as laser printers, facsimile machines, copying machines, etc. are now widely used. These devices form a desired image by forming a latent image on a photoreceptor using a laser, moving toner onto the latent image using an electric potential difference, and then transferring the toner image onto a printing medium such as paper.

FIG. 1 illustrates an embodiment of a non-contact developing-type image forming apparatus. Although not described in detail herein, the present invention can also be applied to a contact developing-type image forming apparatus.

In the non-contact developing-type image forming apparatus of FIG. 1, a non-magnetic one-constituent developing agent 8 is fed to a developing roller 5 by a feeding roller 6 including an elastic member, such as a polyurethane foam, sponge, etc. As the developing roller 5 rotates, the developing agent 8 fed to the developing roller 5 arrives at a line of contact between a developing agent regulating blade 7 and the developing roller 5. The developing agent regulating blade 7 includes an elastic member which is made of metal, rubber, or other suitable materials. Only a thin layer of the developing agent 8 can pass between the developing agent regulating blade 7 and the developing roller 5. The thin layer of the developing agent on the roller 5 is electrically charged. The thin layer of developing agent 8 is then rotated to a developing area where it is transferred from the developing roller 5 to an electrostatic latent image formed on a photoreceptor 1.

The developing roller 5 and the photoreceptor 1 face each other and are separated by a predetermined distance. The developing roller 5 rotates counterclockwise and the photoreceptor 1 rotates clockwise. The developing agent 8 is applied to the developing area and is transferred onto the electrostatic latent image of the photoreceptor 1 by force generated by an electric potential difference between the developing roller 5, to which a DC-offset AC voltage is applied. The latent image formed on the photoreceptor 1.

As the photoreceptor 1 rotates, the developing agent 8 on the photoreceptor 1 arrives at a transfer means 9 and is transferred onto a printing paper 13 by the transfer means 9 to form an image. Here, the transfer means 9 may use a corona discharge or may have a roller form. The transfer means 9 is maintained at a high voltage of opposite polarity to the developing agent 8.

The image transferred to the printing paper 13 is fused onto the printing paper 13 by passing through a high-temperature and high-pressure fusing apparatus (not shown). Meanwhile, residual developing agent on the developing roller 5 is recovered by a feeding roller 6 which contacts the developing roller 5. This process is repeated.

In a non-magnetic one-constituent non-contact developing apparatus, a developing agent obtains electric charge through frictional contact with a developing agent carrier, a developing agent regulating blade, and a feeding member. And since a latent image carrier and the developing agent carrier are separated by a predetermined distance, the developing agent is transferred by electrical force alone. Thus, when the developing agent is charged below the proper level, an insufficient amount may be transferred to the latent image, thereby reducing image density. And, when the developing agent is charged above the proper level, it may be transferred to a non-image area, thereby causing image contamination.

Moreover, even if the developing agent initially shows proper charge characteristics, as a printing process is repeated, external additives of the developing agent either become embedded in a resin of the developing agent due to stress caused by friction between the developing agent and the developing agent regulating blade, or are separated from the developing agent. If this occurs, the mobility of the developing agent decreases, and physical absorbency between the developing agent carrier, the developing agent regulating blade, and the developing agent increases. Thus, uniform frictional charging of the developing agent may not occur such that the developing agent is not charged to the proper level or is charged with the wrong polarity, thereby reducing image density or causing image contamination.

Increasing the amount of external additives to prevent such problems causes an increase in the amount of frictional charge of the developing agent and hence an increase in the force between the developing agent and the developing agent carrier. However, increasing the amount of the external additives decreases the image density. Also, as the amount of external additives is increased, the ability of a cleaning blade contacting the latent image carrier to effectively remove all remaining developing agent deteriorates causing a charging roller to be contaminated. In addition, the residual developing agent or impurities remain on the latent image carrier. This deteriorates image quality by causing spots and vertical white/black lines in an image.

Japanese Patent Publication No. 1999-212293 discloses a non-magnetic one-constituent developing agent containing at least one type of inorganic material and strontium titanate. Japanese Patent Publication No. 2003-202702 discloses a negatively chargeable toner containing two types of silicas with different mean particle diameters as external additives, and hydrophobic titanium oxide. However, these developing agents cannot obtain a uniform image density when printing for a long time and produce poor quality, blurry images.

SUMMARY OF THE INVENTION

The present invention provides an electrophotographic developing agent that maintains a stable charge and charge distribution of a toner regardless of environmental changes and length of time image printing is performed. The electrophotographic developing agent of the invention prevents image defects such as blurring and image contamination due to contamination of a developing member by separation or movement of the external additive on the toner particles.

The present invention provides an electrophotographic image forming apparatus using the developing agent.

According to an aspect of the present invention, there is provided an electrophotographic developing agent including: toner particles including a binder resin, a colorant, and a charge control agent; and an external additive added to the surface of the toner particles, wherein the external additive includes at least one component or type of inorganic particulate and at least two types of hydrophobic strontium titanate particulate component having different mean primary particle diameters. In one preferred embodiment, the inorganic particulate component does not include strontium titanate.

According to another aspect of the present invention, there is provided an electrophotographic image forming apparatus using the electrophotographic developing agent.

BRIEF DESCRIPTION OF THE DRAWING

The above and other features and advantages of the present invention will become more apparent by describing in detail exemplary embodiments thereof with reference to the attached drawing in which.

DETAILED DESCRIPTION OF THE INVENTION

Figure 1:
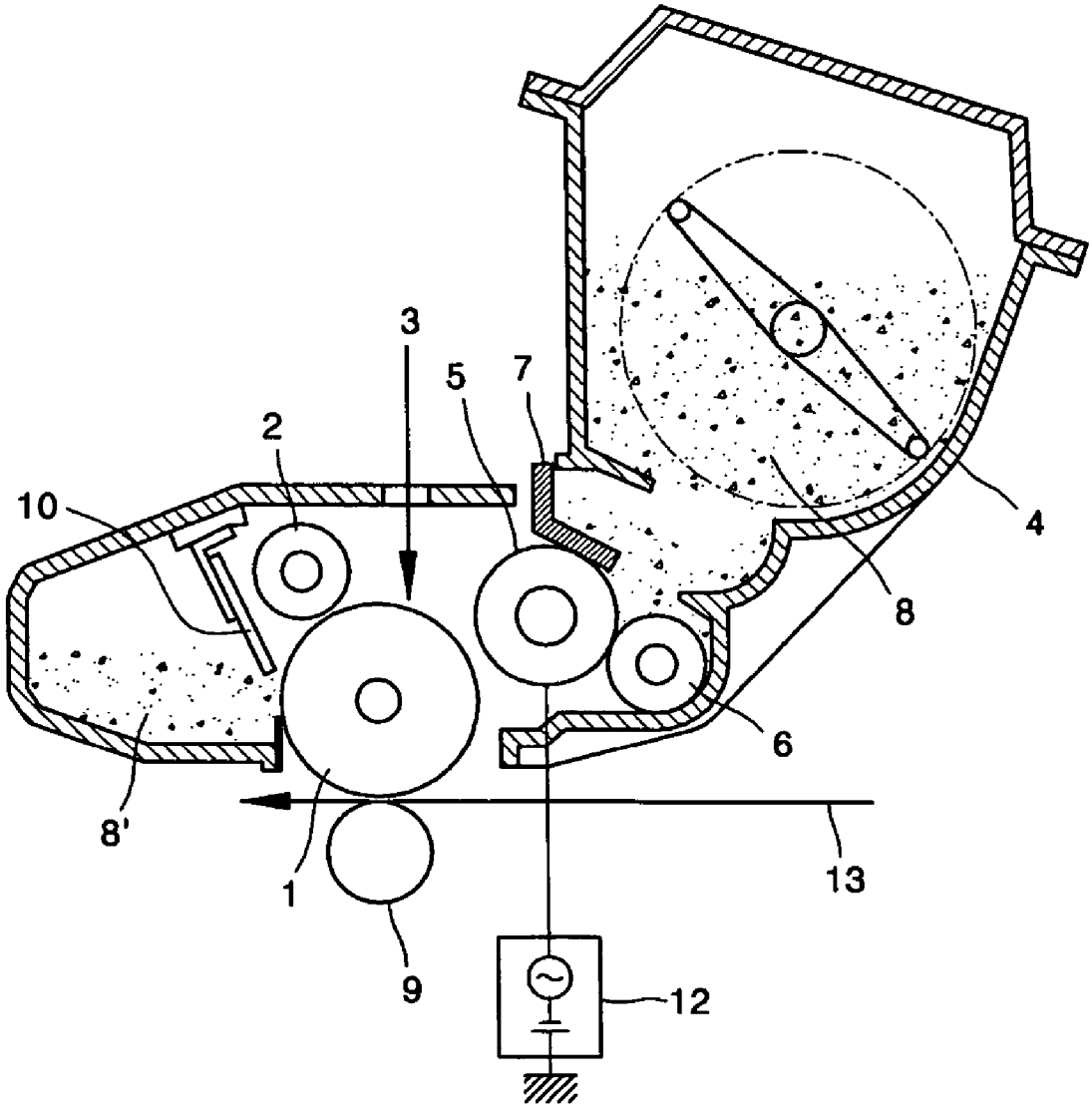
FIG. 1 is a schematic diagram illustrating an embodiment of a non-contact developing-type electrophotographic apparatus.

The present invention will now be described in more detail with reference to exemplary embodiments thereof.

The present invention provides an electrophotographic developing agent including: toner particles including a binder resin, a colorant, and a charge control agent, referred to as the parent toner particles; and an external additive added to the surface of the toner particles, wherein the external additive includes at least one inorganic particulate component and at least two hydrophobic strontium titanate particulate components having different mean primary particle diameters. The inorganic particulate component preferably does not include strontium titanate.

According to an embodiment of the present invention, the strontium titanate particulate component can include a first strontium titanate particulate component having a mean particle diameter of 10-100 nm and a second strontium titanate particulate component having a mean particle diameter of 110-500 nm.

The total amount of the first and second strontium titanate particulates is about 0.4 to about 4.0 parts by weight based on 100 parts by weight of parent toner particles.

The amount of the first strontium titanate component is preferably at least 50% by weight of the total amount of strontium titanate particulate components. Typically, the second titanate component having a mean particulate diameter of 110-500 nm is at least about 10% by weight and less than about 50% by weight based on the total amount of the strontium titanate. In another embodiment, the strontium titanate component comprises about 50% to about 90% of the first strontium titanate component having a particle size of 10-100 nm and about 10% to 50% of the second strontium titanate component having a particle size of 110-500 nm where the percentages are based on the total weight of the strontium titanate particles. In still another embodiment, the strontium titanate component comprises about 50% to about 80% of the first strontium titanate and about 20% to about 50% of the second strontium titanate component where the percentages are based on the total weight of the strontium titanate. In one embodiment, the strontium titanate component includes about 70% of the first strontium titanate component and about 30% of the second strontium titanate component where the percentages are based on the total weight of the strontium titanate.

The inorganic particulate component may be at least one selected from the group consisting of silica, titanium dioxide, aluminum oxide, zinc oxide, magnesium oxide, cerium oxide, iron oxide, copper oxide, and tin oxide. In other embodiments, the inorganic particulate can be a mixture of two or more of these components. Preferably, the inorganic component is not strontium titanate and is substantially in the absence of strontium titanate.

The amount of the inorganic particulate is preferably about 0.1 to about 3.0 parts by weight based on 100 parts by weight of parent toner particulates.

The inorganic particulate is preferably composed of a large diameter silica having a mean particle diameter of about 20 to about 200 nm and/or a small diameter silica having a mean particle diameter of about 5 to about 20 nm.

For a general polymerizing and pulverizing toner, a colorant, a charge control agent, a release agent, and other component are uniformly added to a binder resin to improve chromaticity, charge characteristic, and fusing property. Various external additives are further added to provide the toner with fluidity, charge stability, and cleaning property. When adding the external additives, at least two types of external additives having different mean particle diameters may be used together to prevent the external additives from separating from the surface of a toner and embedding therein.

To make the developing agent fluid, at least one type of inorganic particulate is externally added to the surface of a colored toner particle. The inorganic particulate may be at least one selected from the group consisting of silica, aluminum oxide, zinc oxide, magnesium oxide, cerium oxide, iron oxide, copper oxide, and tin oxide. Preferably, a mixture of at least two types of inorganic particulate components having different particle diameters are added.

The two types of inorganic particulate components can include large diameter particulates having a mean particle diameter of about 20 to about 200 nm and small diameter particulates having a mean particle diameter of about 5 to about 20 nm. When inorganic particulates having different particle diameters are used, large diameter particulates act as spacers that prevent deterioration of the toner and improve a transfer property, and small diameter particulates mainly provide the toner with fluidity.

The total amount of inorganic particulates is about 0.1 to about 3.0 parts by weight, and preferably about 0.3 to about 2.0 parts by weight, based on 100 parts by weight of parent toner particles. When the amount of inorganic particulates is less than 0.1 part by weight, it is difficult to obtain the desired fluidity. When the total amount of inorganic particulates is greater than 3.0 parts by weight, charge quantity of the toner is not uniform and manufacturing and preparation costs increase.

The developing agent according to an embodiment of the present invention includes an effective amount of strontium titanate comprising at least two components or types of strontium titanate particulates where each component has different mean primary particle diameters.

A first strontium titanate particulate component has a mean primary particle diameter of about 10 to about 100 nm, and preferably about 30 to about 90 nm. A second strontium titanate particulate component has a mean primary particle diameter of about 110 to about 500 nm, and preferably about 30 to about 400 nm.

By externally adding at least two types of strontium titanate particulates having different particle diameters, developing of a toner in a non-image area, i.e., fog, and vertical lines on an image due to deposition of toner on a developing agent regulating blade, can be prevented for the entire lifetime of a developing machine.

The first strontium titanate component having a smaller mean primary particle diameter prevents fog effectively in the initial stages but over time its effectiveness at preventing fog decreases and toner particles are easily deposited on a developing agent regulating blade. This is because the external additive does not separate from the toner particle surface but becomes embedded in the toner particle due to stress.

Meanwhile, the second strontium titanate component having a larger mean primary particle diameter does not prevent fog in the initial stages but over time effectively prevents fog later and is not deposited on the developing agent regulating blade. This is because when the developing agent is subjected to stress, the second strontium titanate separates from the toner particle surface and accumulates to act as a carrier that uniformly charges the toner and as an abrasive that removes toner deposited on the developing agent regulating blade.

Thus, when two types of strontium titanate particulates having different particle diameters are externally added together, their mutually compensatory functions together prevent fog and deposition of a toner on the developing agent regulating blade.

The total amount of the first and second strontium titanate particulate component is about 0.4 to about 4.0 parts by weight, and preferably about 0.6 to about 3.0 parts by weight, based on 100 parts by weight of parent toner particles. When the total amount of strontium titanate particulates is less than 0.4 part by weight, the desired charging property is not obtained, which leads to the formation of fog. When the total amount of strontium titanate particulates is greater than 4.0 parts by weight, the toner is easily deposited on the developing agent regulating blade, which can damage the surface of a latent image carrier, and deteriorate the fluidity of the toner particles.

The amount of the first strontium titanate particulate component having smaller particle diameter is at least 50% by weight of the total amount of strontium titanate particulates. When the amount of the first strontium titanate particulate component is less than 50% by weight, external additives may be embedded in the toner particles and the ability to prevent the formation of fog early on may be reduced.

The strontium titanate components used in the present invention is preferably surface-treated with a hydrophobic agent.

The non-magnetic one-constituent developing agent used in the present invention will now be described.

The parent toner particles include a binder resin, a colorant, a charge control agent, and a release agent.

Various conventional resins can be used as a binder resin in the developing agent according to an embodiment of the present invention. The resin can be a styrene copolymer such as a polystyrene, a poly-P-chlorostyrene, a poly-α-methylstyrene, a styrene-chlorostyrene copolymer, a styrene-propylene copolymer, a styrene-vinyltoluene copolymer, a styrene-vinyinaphthalene copolymer, a styrene-acrylic acid methyl copolymer, a styrene-acrylic acid ethyl copolymer, a styrene-acrylic acid propyl copolymer, a styrene-acrylic acid butyl copolymer, a styrene-acrylic acid octyl copolymer, a styrene-methacrylic acid methyl copolymer, a styrene-methacrylic acid ethyl copolymer, a styrene-methacrylic acid propyl copolymer, a styrene-methacrylic acid butyl copolymer, a styrene-α-chloromethacrylic acid methyl copolymer, a styrene-acrylonitrile copolymer, a styrene-vinylmethylether copolymer, a styrene-vinylethylether copolymer, a styrene-vinylethylketone copolymer, a styrene-butadiene copolymer, a styrene-acrylonitrile-inden copolymer, a styrene-maleic acid copolymer, a styrene-maleic acid ester copolymer, etc., a polymethylmethacrylate, a polyethylmethacrylate, a polybutylmethacrylate and copolymers thereof, a polyvinyl chloride, a polyvinyl acetate, a polyethylene, a polypropylene, a polyester, a polyurethane, a polyamide, an epoxy resin, a polyvinylbutyral resin, a rosin, a denatured rosin, a terpene resin, a phenol resin, an aliphatic or alicyclic hydrocarbon resin, an aromatic petroleum resin, a chlorinated resin, a paraffin wax, etc., and combinations thereof. The polyester resin is suitable for a color-developing agent due to its superior fusing property and transparency.

The developing agent according to an embodiment of the present invention can further comprise a colorant. For a black and white toner, carbon black or aniline black can be used as a colorant. It is easy to prepare a non-magnetic color toner according to an embodiment of the present invention. Carbon black is typically used as a black color for a colorant in colored toners. Yellow, magenta and cyan colorants are also suitable for producing colored toners.

The yellow colorant can be a condensed nitrogen compound, an isoindolinone compound, an anthraquinone compound, an azo metal complex or an allyl amide compound. Specifically, C.I. pigment yellow 12, 13, 14, 17, 62, 74, 83, 93, 94, 95, 109, 110, 111, 128, 129, 147 or 168, etc. can be used.

The magenta colorant can be a condensed nitrogen compound, an anthraquinone compound, a quinacridone compound, a basic dye lake compound, a naphthol compound, a benzoimidazole compound, a thioindigo compound or a perylene compound. Specifically, C.I. pigment red 2, 3, 5, 6, 7, 23, 48:2, 48:3, 48:4, 57:1, 81:1, 144, 146, 166, 169, 177, 184, 185, 202, 206, 220, 221 or 254, etc., can be used.

The cyan colorant can be a copper phthalocyanine and its derivative, an anthraquinone compound or a basic dye lake compound. Specifically, C.I. pigment blue 1, 7, 15, 15:1, 15:2, 15:3, 15:4, 60, 62 or 66, etc. can be used.

The colorant can be used alone or in a mixture of at least two types of colorants, and can be selected in consideration of color, saturation, brightness, durability, dispersibility in the toner, etc.

The amount of colorant is sufficient to form a visible image by development, and can be 2 to 20 parts by weight based on 100 parts by weight of a binder resin. If less than 2 parts by weight of the colorant is used, colorizing effects are insufficient. If the amount of colorant exceeds 20 parts by weight, the electrical resistance becomes low, and thus sufficient frictional charge cannot be obtained, and thus there is a danger of contamination.

The charge control agent can be a negative charge control agent or a positive charge control agent, and the negative charge control agent can be an organic metal complex such as a chromium-containing azo dye or a monoazo metal complex, or a chelate compound; a salicylic acid compound containing metals such as chromium, iron and zinc; or an organic metal complex such as aromatic hydroxycarboxylic acid and aromatic dicarboxylic acid, although the charge control agent is not limited to these materials. The positive charge control agent can be a product modified with nigrosine and its fatty acid metal salt, etc.; an onium salt comprising quaternary ammonium salt such as tributylbenzylammonium 1-hydroxy4-naphthosulfonate and tetrabutylammonium tetrafluoroborate; or combinations thereof. The charge control agents support toner on the developing roller by electrostatic force in a stable manner to obtain stable and rapid charging of the charge control agent.

The amount of the charge control agent in the toner composition is generally about 0.1 to about 10% by weight.

The toner particles according to an embodiment of the present invention can further comprise a release agent, a higher fatty acid, and its metal salt. The release agent can be a polyalkylene wax such as low molecular weight polypropylene, low molecular weight polyethylene, etc., an ester wax, a carnauba wax, a paraffin wax, a higher fatty acid, a fatty acid amide, and the like The higher fatty acid and its metal salt can be added to protect the photoreceptor and prevent deterioration of the developing property, thereby maintaining high image quality.

The colorant can be previously flushed to uniformly disperse in the binder resin or a master batch of the colorant and the binder resin melt-kneaded in high concentration can be used. For example, the binder resin and the colorant can be mixed by a kneading means, such as a 2-roll, 3-roll, and pressure type kneader, or twin-screw extruder. At this time, the colorant should be uniformly dispersed and is melt-kneaded at 80-180° C. for 10 min to 2 hr. Then, the mixture is finely pulverized using a pulverizer, such as a jet mill, an attritor mill, or a rotatory mill to obtain toner particles having a mean particle diameter of 3-15 μm. The external additives are attached to the resulting toner particles to improve fluidity and charge stability.

The developing agent according to an embodiment of the present invention can also be prepared by a polymerization method as well as a melt-kneading pulverizing method. To attach the external additives to toner particles, the toner particles and the external additives were combined in a desired ratio, and the mixture was supplied to an agitator such as HENSCHEL mixer and stirred so that the external additives attach to the surface of the toner particles. In another experiment, both particles were mixed with a surface modifier such as, 'NARA HYBRIDIZER' and stirred so that the external additives attach to the toner particles by being at least partly embedded into the surface of the toner particles.

The developing agent according to an embodiment of the present invention can also be applied to a toner of a non-magnetic one-constituent contact-type developing method as well as to the electrophotographic apparatus using a non-contact non-magnetic one-constituent toner. The developing agent can also be applied to both a negatively charged toner and a positively charged toner.

The present invention also provides an electrophotographic image forming apparatus using the electrophotographic developing agent described above.

The present invention will now be described in greater detail with reference to the examples. The following examples are for illustrative purposes only and are not intended to limit the scope of the invention.

EXAMPLES

Preparation of Toner Particles 90.5 parts by weight of a polyester having a weight-average molecular weight of 100,000, 5 parts by weight of carbon black (manufactured by Mitsubishi Chemical Co.), 2.5 parts by weight of a negative charge control agent (manufactured by Hodogaya, Fe complex) and 2 parts by weight of a low molecular weight polypropylene wax (manufactured by Sanyo Chemical Industry Co.) were pre-mixed using a HENSCHEL mixer. Then, the mixture was infused into a twin screw extruder and a melted mixture was extruded at 130° C. and cooled to coagulate. Then, an untreated toner with a mean particle diameter of about 8 μm was obtained using a grinding classifier to obtain toner particles. The following external additives were added to the toner particles. In the following Examples, the percentage of the external additives are based on the weight of the toner particles.

Example 1

The following external additives were externally added to the toner particles to obtain the toner according to an embodiment of the present invention.

External additives:

Silica (mean primary particle diameter: 7 to 16 nm, available from Nippon Aerosil)=1.0 % by weight Strontium titanate (mean primary particle diameter: 70 nm) 1.0 % by weight Strontium titanate (mean primary particle diameter: 200 nm) =0.4% by weight.

Example 2

A toner was prepared in the same manner as in Example 1, except that the following external additives were externally added to the colored toner particles.

External additives:

$TiO_2$ (mean primary particle diameter: 20 nm, available from Titanium Industry Co.)=1.0 % by weight Strontium titanate (mean primary particle diameter: 70 nm)=1.0 % by weight Strontium titanate (mean primary particle diameter: 200 nm)=0.4% by weight.

Example 3

A toner was prepared in the same manner as in Example 1, except that the following external additives were externally added to the colored toner particles.

External additives:

Silica (mean primary particle diameter: 7 to 16 nm, available from Nippon Aerosil)=1.0 % by weight Strontium titanate (mean primary particle diameter: 70 nm)=0.4 % by weight Strontium titanate (mean primary particle diameter: 200 nm)=1.0 % by weight.

Comparative Example 1

A toner was prepared by adding the following external additives to untreated toner prepared by the pulverizing method.

External additives:

Silica (mean primary particle diameter: 7 to 16 nm, available from Nippon Aerosil)=1.0 % by weight Strontium titanate (mean primary particle diameter: 70 nm)=1.4 % by weight.

Comparative Example 2

A toner was prepared by adding the following external additives to untreated toner prepared by the pulverizing method.

External additives:

Silica (mean primary particle diameter: 7 to 16 nm, available from Nippon Aerosil)=1.0 % by weight Strontium titanate (mean primary particle diameter: 200 nm)=1.4 % by weight

Image Evaluation Test (Based on Negatively Charged Toner)

Operational parameters of a developing apparatus used in this test were as follows.

Surface electric potential ($V_0$): −600 V

Latent image electric potential (VL): −100 V

Voltage applied to developing roller:

Vp-p=1.8 KV, frequency=2.0 kHz,
Vdc=−300V, efficiency ratio=35% (spherical wave)
Developing gap: 300 μm
Developing roller:
(1) For aluminum
intensity of illumination: Rz=1-2.5 (after doping with nickel)
(2) For rubber roller (NBR-based elastic rubber roller)
resistance: 0.1-5 MΩ
hardness: 50
Toner: charge per mass (q/m)=−5 to −30 μC/g
(on developing roller after passing developing agent regulating blade)
mass of toner per area (m/a)=0.3 to 1.0 mg/cm$^2$ Image Evaluation Method (Based on Negatively Charged Toner)

Images produced using the toners of Examples 1 to 3 and Comparative Examples 1 and 2 were evaluated using a 30 ppm-grade laser printer. 8000 sheets of paper were printed in a 5% character pattern at room temperature and atmospheric pressure. Every 1$^{st}$, 2000$^{th}$, 4000$^{th}$, 6000$^{th}$, and 8000$^{th}$ sheet of paper was inspected for fog and vertical stripes. The fog density was obtained by taping fog of the latent image carrier upon printing of a clean sheet of paper using an acetate sticky tape available from 3M and measuring the density using a densitometer (SpectroEye, manufactured by Gretag Macbeth Co.).

Test Results

TABLE 1

| | Fog density (solid) | | | | |
|---|---|---|---|---|---|
| | Initial | 2000 | 4000 | 6000 | 8000 |
| Example 1 | ○ | ○ | ○ | ○ | ○ |
| Example 2 | ○ | ○ | ○ | ○ | ○ |
| Example 3 | ○ | ○ | ○ | ○ | ○ |
| Comparative Example 1 | ○ | ○ | ○ | Δ | x |
| Comparative Example 2 | Δ | x | Δ | ○ | ○ |

TABLE 2

| | Vertical lines | | | | |
|---|---|---|---|---|---|
| | Initial | 2000 | 4000 | 6000 | 8000 |
| Example 1 | ○ | ○ | ○ | ○ | ○ |
| Example 2 | ○ | ○ | ○ | ○ | ○ |
| Example 3 | ○ | ○ | ○ | ○ | ○ |
| Comparative Example 1 | ○ | ○ | ○ | x | x |
| Comparative Example 2 | ○ | ○ | ○ | ○ | ○ |

Basis for Evaluation

In Table 1 above, the fog density evaluation results are indicated as "○" when less than 0.11, as "Δ" when between 0.11 and 0.13, and as "X" when greater than 0.13.

In Table 2 above, the vertical line evaluation results are indicated as "○" when there are no vertical lines and as "X" when there are vertical lines.

In the case of Comparative Example 1, fog and vertical lines occurred by the 6000$^{th}$ sheet of paper, and in the case of Comparative Example 2, fog occurred until about 4000 sheets of paper but decreased thereafter and vertical lines did not occur up to 8000. However, in Examples 1 to 3, neither fog nor vertical lines occurred at all up to 8000 sheets of paper, indicating that when a toner is prepared by externally adding two types of strontium titanate particulates having different mean primary particle diameters, uniform charging characteristics and improved durability can be obtained.

The developing agent according to an embodiment of the present invention includes strontium titanate particulates having different mean primary particle diameters as an external additive to maintain uniform charging characteristics and prevent fog in a non-image area, thereby obtaining good image quality. In addition, deposition of the developing agent on the developing agent regulating blade due to stress when the developing agent is used for a long time can be prevented.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An electrophotographic developing agent comprising:
toner particles comprising a binder resin, a colorant, and a charge control agent; and
an external additive added to the surface of the toner particles,
wherein the external additive comprises at least one inorganic particulate component, and at least two strontium titanate particulate components having different mean primary particle diameters, wherein the at least one inorganic particulate component is not strontium titanate.

2. The electrophotographic developing agent of claim 1, wherein the strontium titanate particulate components comprise a first strontium titanate particulate component having a mean particle diameter of 10 to 100 nm and a second strontium titanate particulate component having a mean particle diameter of 110 to 500 nm.

3. The electrophotographic developing agent of claim 2, wherein the total amount of the first and second strontium titanate particulate components is about 0.4 to about 4.0 parts by weight based on 100 parts by weight of parent toner particles.

4. The electrophotographic developing agent of claim 3, wherein the amount of the first strontium titanate is at least 50% by weight of the total amount of strontium titanate particulate components.

5. The electrophotographic developing agent of claim 3, wherein the strontium titanate particulate components comprise at least 10% by weight and less than 50% by weight of said second strontium titanate component based on the total weight of the strontium titanate components.

6. The electrophotographic developing agent of claim 3, wherein the strontium titanate particulate components comprise about 50% to about 90% by weight of said first strontium titanate component and about 10% to about 50% by weight of said second strontium titanate component, wherein said percentages are based on the total weight of said strontium titanate particles.

7. The electrophotographic developing agent of claim 3, wherein the strontium titanate particulate component comprises about 70% by weight of said first strontium titanate component and about 30% by weight of said second strontium titanate component, wherein said percentages are based on the total weight of the strontium titanate components.

8. The electrophotographic developing agent of claim 1, wherein the strontium titanate particulate components are surface-treated with a hydrophobic agent.

9. The electrophotographic developing agent of claim 1, wherein the inorganic particulate component is selected from the group consisting of silica, titanium dioxide, aluminum oxide, zinc oxide, magnesium oxide, cerium oxide, iron oxide, copper oxide, tin oxide, and mixtures thereof.

10. The electrophotographic developing agent of claim 1, wherein the amount of the inorganic particulate component is about 0.1 to about 3.0 parts by weight based on 100 parts by weight of toner particles.

11. The electrophotographic developing agent of claim 1, wherein the inorganic particulate component consists of large particle diameter silica having a mean particle diameter of 20 to 200 nm and/or small particle diameter silica having a mean particle diameter of 5 to 20 nm.

12. The electrophotographic developing agent of claim 1, wherein said external additive comprises about 0.1 to about 3.0 parts by weight of said inorganic particulate component and about 0.4 to about 4.0 parts by weight of said strontium titanate particulate components, wherein said parts by weight are based on 100 parts by weight of said toner particles.

13. An electrophotographic image forming apparatus using the electrophotographic developing agent of claim 1.

* * * * *